US011826716B2

(12) United States Patent
Cox

(10) Patent No.: US 11,826,716 B2
(45) Date of Patent: Nov. 28, 2023

(54) HYDRAULIC MUD SHEARING SYSTEM

(71) Applicant: Morgan Specialty Services, Inc., Houston, TX (US)

(72) Inventor: Camaron M. Cox, Houston, TX (US)

(73) Assignee: Morgan Specialty Services, Inc., Houston, TX (US)

( * ) Notice: Subject to any disclaimer, the term of this patent is extended or adjusted under 35 U.S.C. 154(b) by 0 days.

(21) Appl. No.: 18/060,707

(22) Filed: Dec. 1, 2022

(65) Prior Publication Data

US 2023/0166224 A1 Jun. 1, 2023

Related U.S. Application Data

(60) Provisional application No. 63/284,964, filed on Dec. 1, 2021.

(51) Int. Cl.
*B01F 25/00* (2022.01)
*B01F 25/452* (2022.01)
*E21B 21/06* (2006.01)
*B01F 101/49* (2022.01)

(52) U.S. Cl.
CPC ..... *B01F 25/4521* (2022.01); *B01F 25/4522* (2022.01); *E21B 21/062* (2013.01); *B01F 2101/49* (2022.01)

(58) Field of Classification Search
CPC . B01F 25/4522; B01F 25/4521; E21B 21/062
See application file for complete search history.

(56) References Cited

U.S. PATENT DOCUMENTS

2013/0021868 A1* 1/2013 Doolin ..... B01F 23/41 366/154.1
2013/0269735 A1* 10/2013 Roetzel ..... B08B 3/102 134/40

* cited by examiner

*Primary Examiner* — Anshu Bhatia

(57) ABSTRACT

Systems and methods to obtain a desired rheology of drilling mud are described herein. Embodiments generally include a hollow tubular body coupled to, and including, numerous shearing elements configured to facilitate achievement of such desired rheology.

8 Claims, 22 Drawing Sheets

HYDRAULIC MUD SHEARING SYSTEM

CROSS-REFERENCE TO RELATED APPLICATION

This present application is based on and claim the benefit of Provisional patent application No. 63/284,964 filed Dec. 1, 2021, the disclosure of which is incorporated by reference herein in its entirety.

BACKGROUND

1. Technical Field

This disclosure relates to a shearing system, specifically to a shearing system for emulsifying drilling mud.

2. Description of Related Art

Drilling mud is often used to carry cuttings out of the hole during drilling operations. Rheology is an important property of drilling muds, drill-in fluids, workover and completion fluids, cements, and specialty fluids and pills. The rheology of the drilling d directly influences the cutting transportability, hole cleaning ability, lubricity, and filtration loss behavior while drilling. Shearing drilling mud prior to transport can help reduce the need for temporary viscosifiers.

To obtain optimum rheology in a final product, a shearing system that can handle drilling mud of various properties is needed. Traditionally, shearing water-based, oil-based, and synthetic-based drilling mud through the nozzles of a drill bit in liquid mud plants has been a challenge when drilling and servicing hydrocarbon wells.

Previous attempts to solve this problem have failed to shear the smallest particles within the drilling mud and have failed to adequately disrupt the flow of fluid within the shearing system. Failure to adequately disrupt the flow within the shearing system can further hinder the ability to generate a homogenous drilling mud. A need exists for a more efficient shearing system that emulsifies drilling mud with the required rheological properties using optimum product concentrations.

SUMMARY

Various embodiments and systems and methods to shear drilling mud are described herein. Such embodiments generally include a hollow tubular body coupled to a high-pressure pump, the pump capable of flowing drilling mud into the hollow tubular body; an inlet; one or more jet nozzles capable of withstanding high hydraulic pressure, wherein the jet nozzles allow fluid to flow from a first portion of the hollow tubular body to a second portion of the hollow tubular body at a predetermined angle; a baffle plate system comprising at least one baffle plate; and an outlet.

One or more embodiments include the drilling mud shearing system of the preceding paragraph wherein the first portion of the hollow tubular body is a high-pressure chamber, and the second portion of the hollow tubular body is a low-pressure chamber.

One or more embodiments include the drilling mud shearing system of any preceding paragraph wherein the drilling mud is water-based.

One or more embodiments include the drilling mud shearing system of any preceding paragraph wherein the drilling mud is oil-based.

Methods of shearing drilling mud in accordance with such embodiments generally include pumping drilling mud into an inlet of a hollow tubular body at a high pressure; flowing the drilling mud through a plurality of jet nozzles at predetermined angles into a baffle plate system, wherein the baffle plate system comprises at least one baffle plate to disrupt water droplets within the drilling mud to form an emulsified fluid; and directing the emulsified fluid through an outlet in the hollow tubular body.

DETAILED DESCRIPTION

Figure 16:
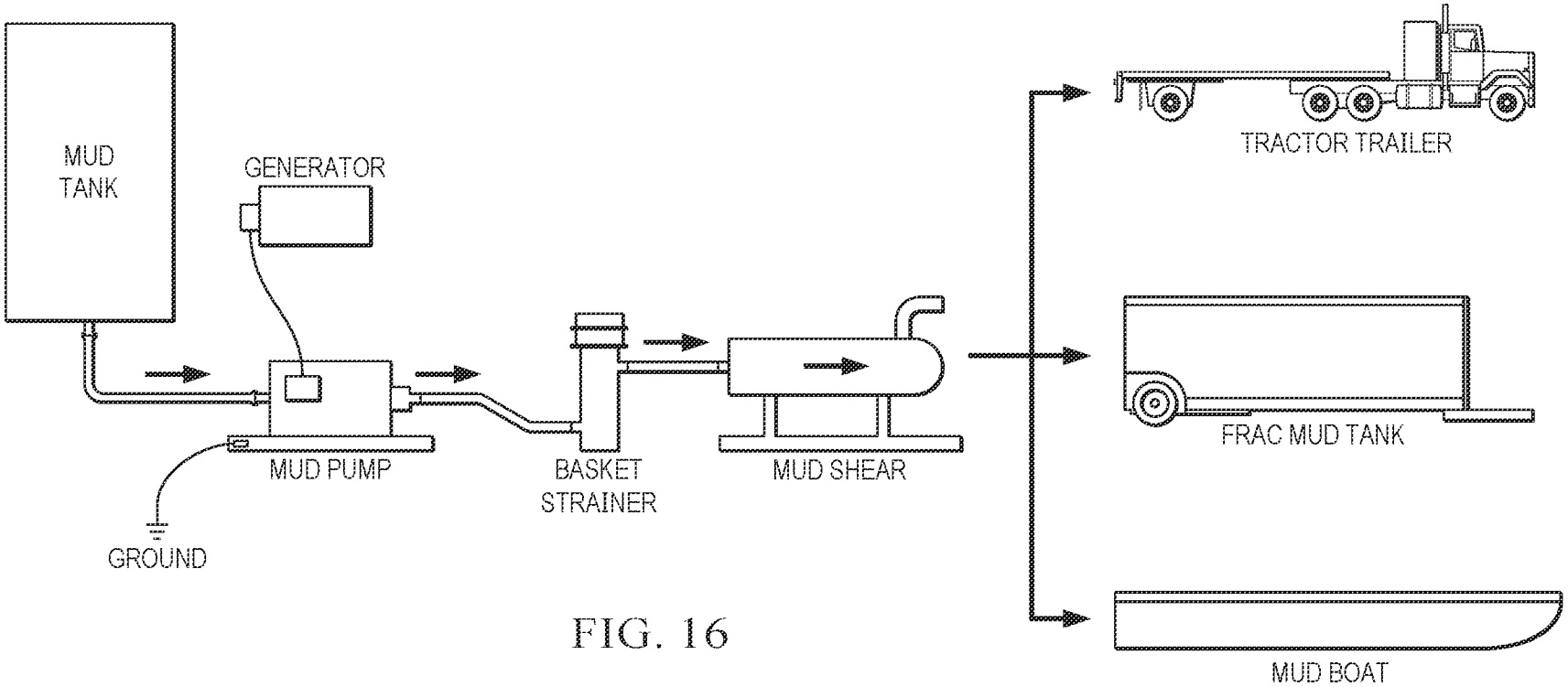
FIG. 16 is a diagram depicting the flow of a fluid from a fluid source through a mud shearing system in accordance with various embodiments of the present disclosure.
Figure 17:
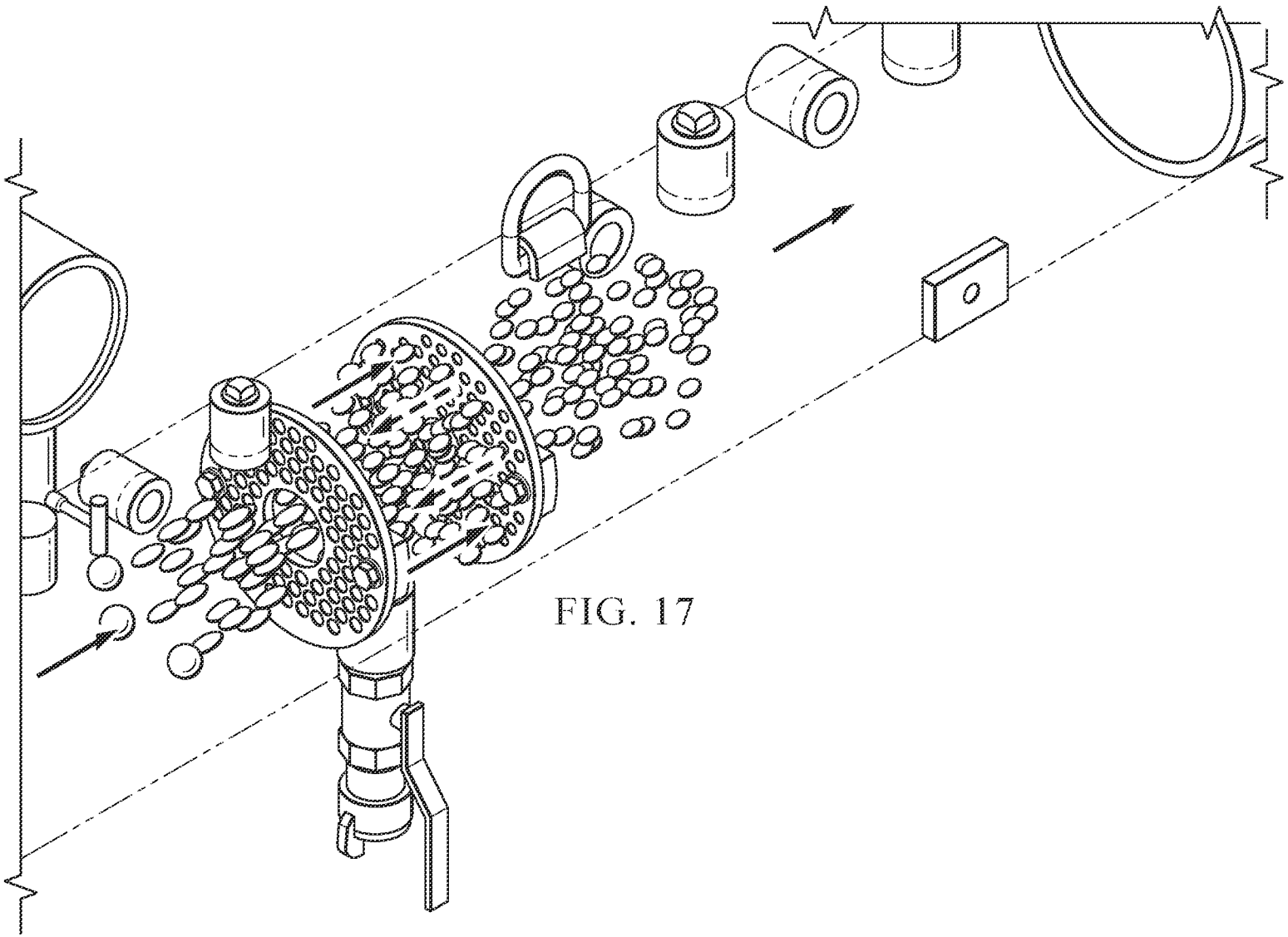
FIG. 17 is a sectional, perspective view of fluid flow through a mud shearing system in accordance with various embodiments of the present disclosure.

This disclosure generally relates to systems and methods for emulsifying or shearing mud used in drilling operations. FIG. 16 depicts a flow diagram for a fluid (drilling mud) from a fluid source through a shearing system.

While various embodiments of the present disclosure are described below, the scope of this disclosure is not limited to such embodiments, which are included to enable a person having ordinary skill in the art to make and use the inventions when the information in this patent is combined with available information and technology. Various modifications to the disclosed embodiments, as well as alternative embodiments of the present disclosure, will be apparent to persons skilled in the art upon reference to the description of the disclosed embodiments.

As shown in FIGS. 1-3 and 7, a mud shearing system in accordance with some embodiments of the present disclosure comprises an inlet portion 4, a shearing plate 6, a main body 3, and an outlet vessel 1. Inlet portion 4 may comprise an inlet assembly 42 having a plurality of inlet flanges coupled to one another. Each inlet flange may be configured to accommodate a change in diameter of pipes or other bodies coupled to either side of the flange. The flanges may be coupled in sequence to facilitate a gradual increase in vessel diameter. Each inlet flange may be a commercially available flange that is ASME certified up to 3,000 psi. In various embodiments, the inlet assembly and main body 3 are arranged to be in fluid communication. Main body 3 may be a substantially tubular vessel ASME certified up to 300 psi. Shearing plate 6 may be disposed between the inlet assembly and main body 3 and configured to modify the flow rate of a fluid, such as drilling mud, that is passing from the inlet assembly to main body 3 through shearing plate 6.

Figure 1:
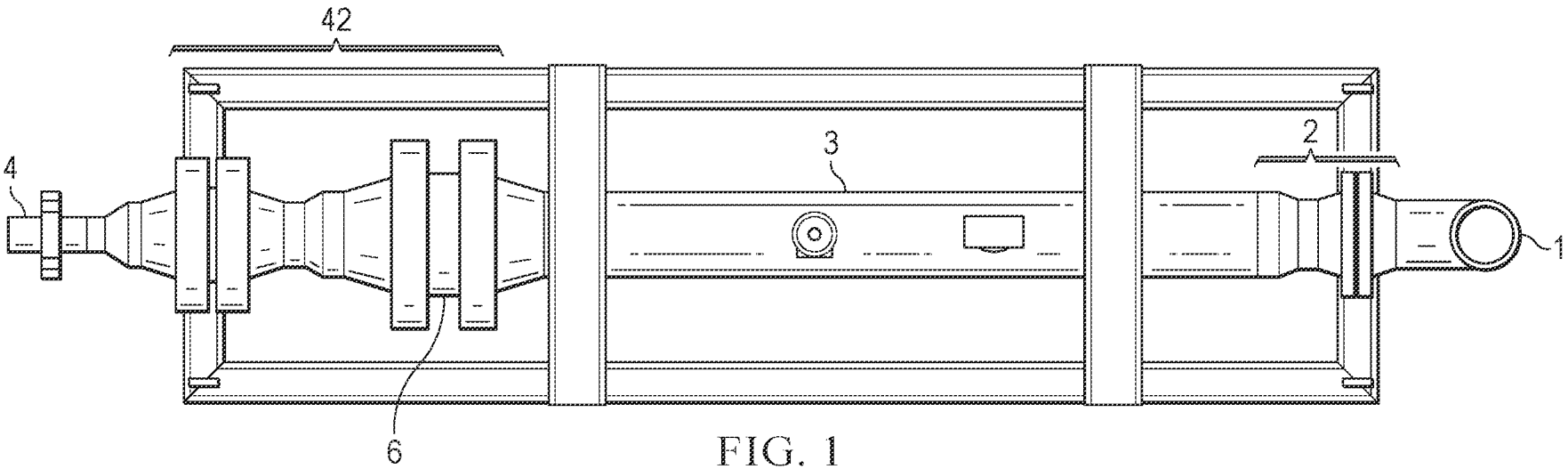
FIG. 1 is a top view of a mud shearing system in accordance with various embodiments of the present disclosure.
Figure 2:
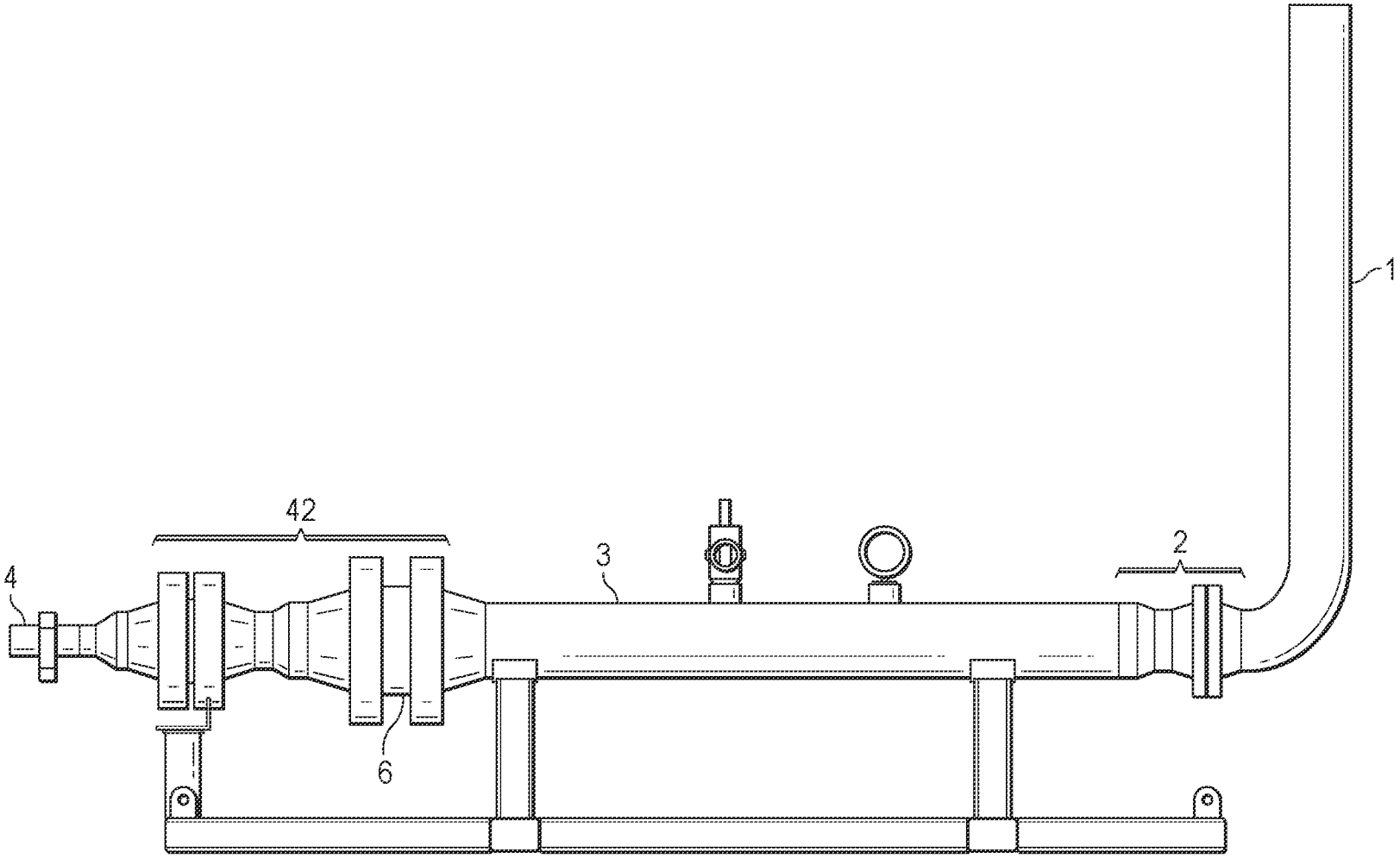
FIG. 2 is a side view of a mud shearing system in accordance with various embodiments of the present disclosure.
Figure 3:
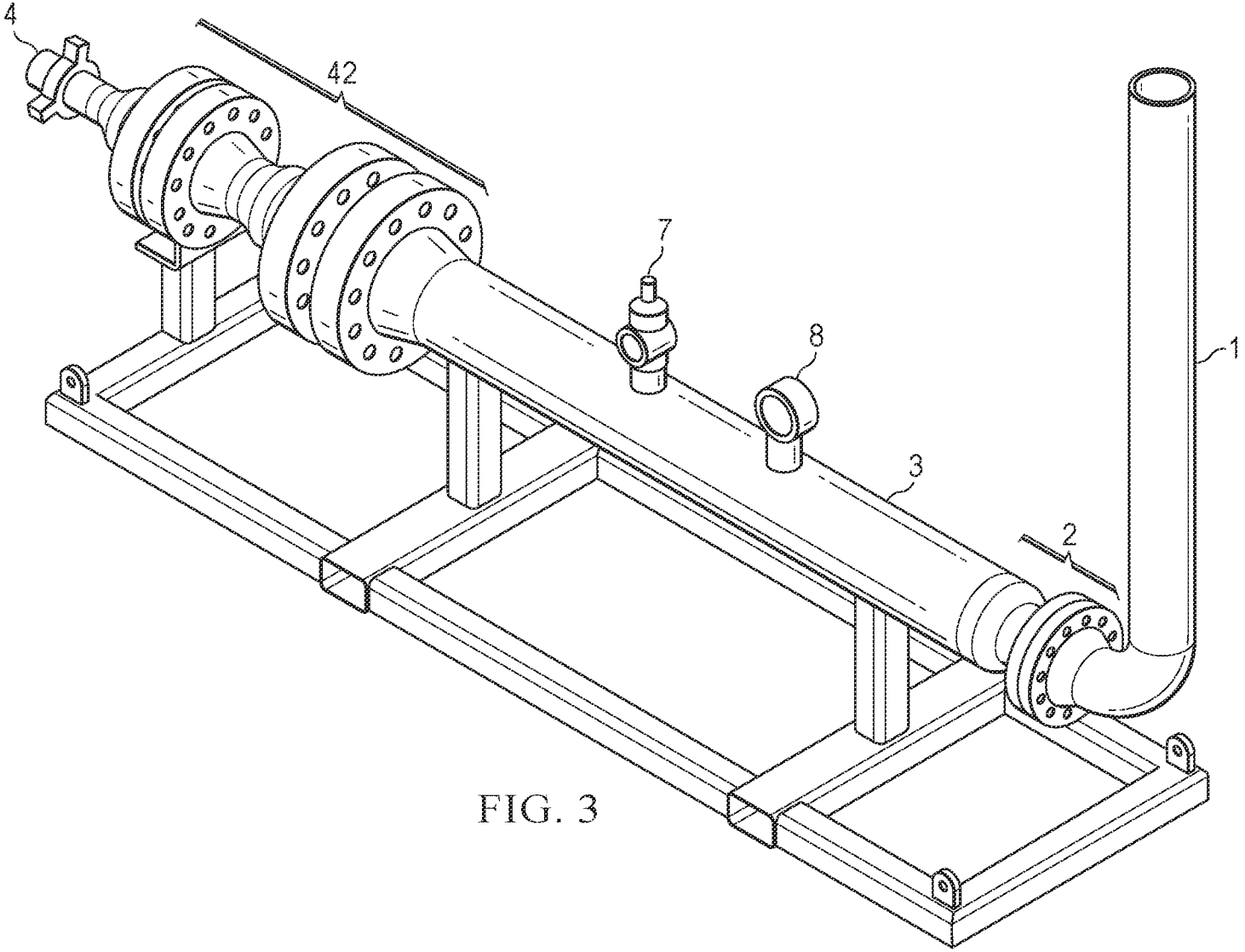
FIG. 3 is a perspective view of a mud shearing system in accordance with various embodiments of the present disclosure.
Figure 4:
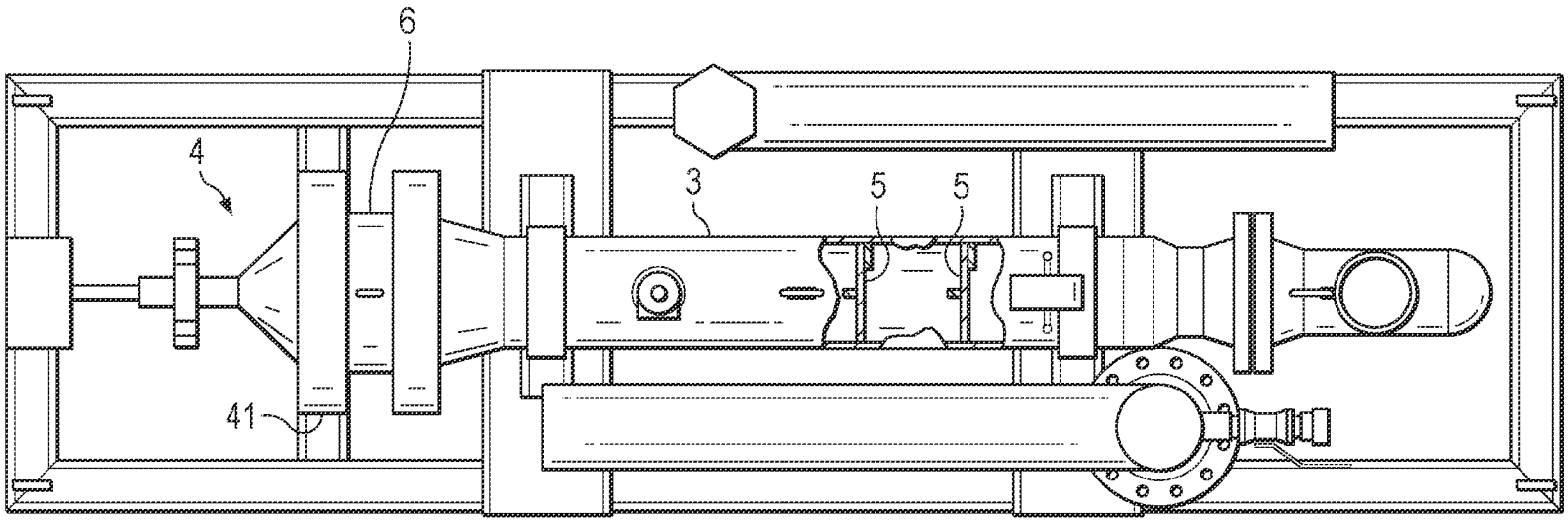
FIG. 4 is a top, partial cutaway view of a mud shearing system in accordance with various embodiments of the present disclosure.
Figure 5:
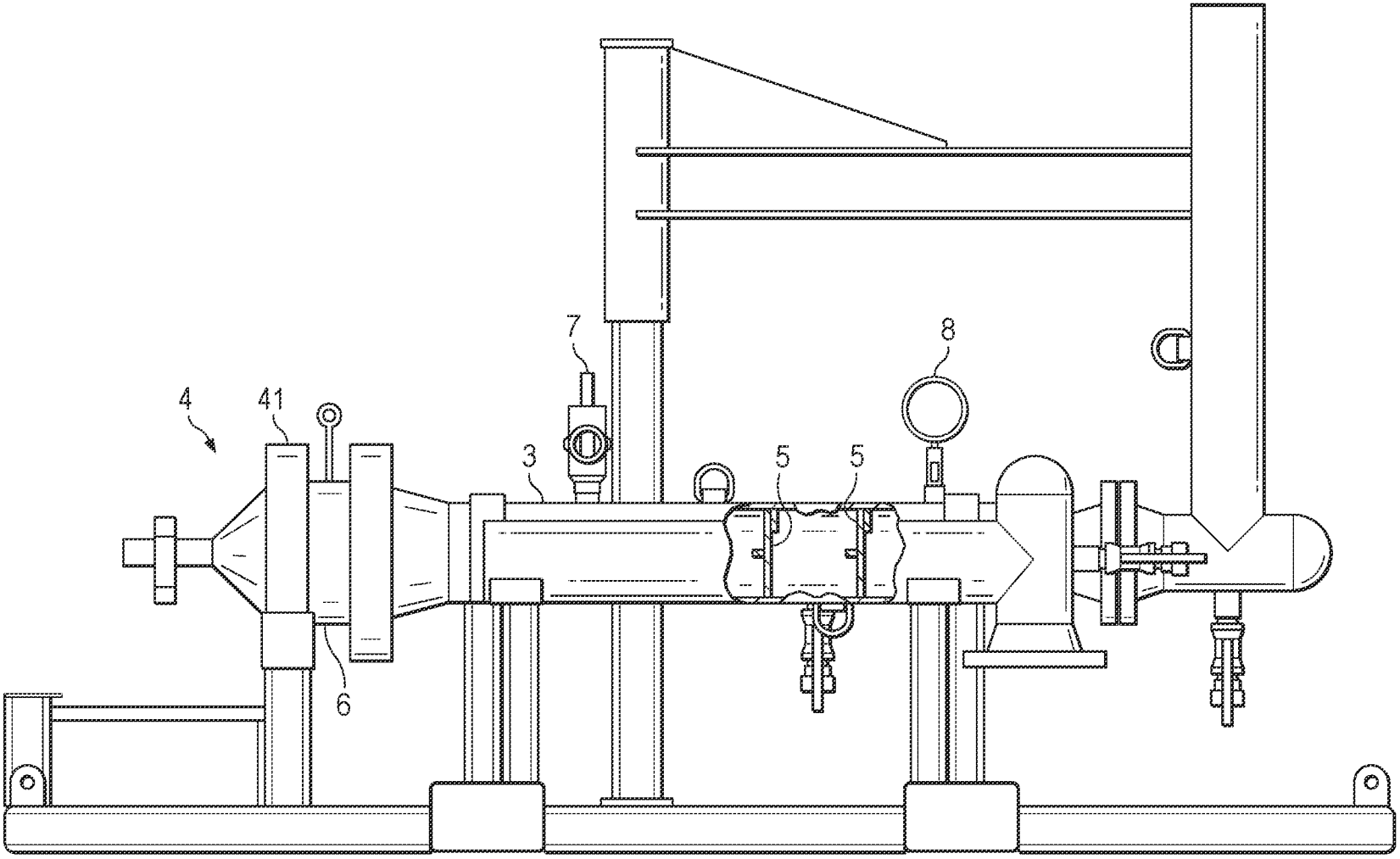
FIG. 5 is a side, partial cutaway view of a mud shearing system in accordance with various embodiments of the present disclosure.
Figure 6:
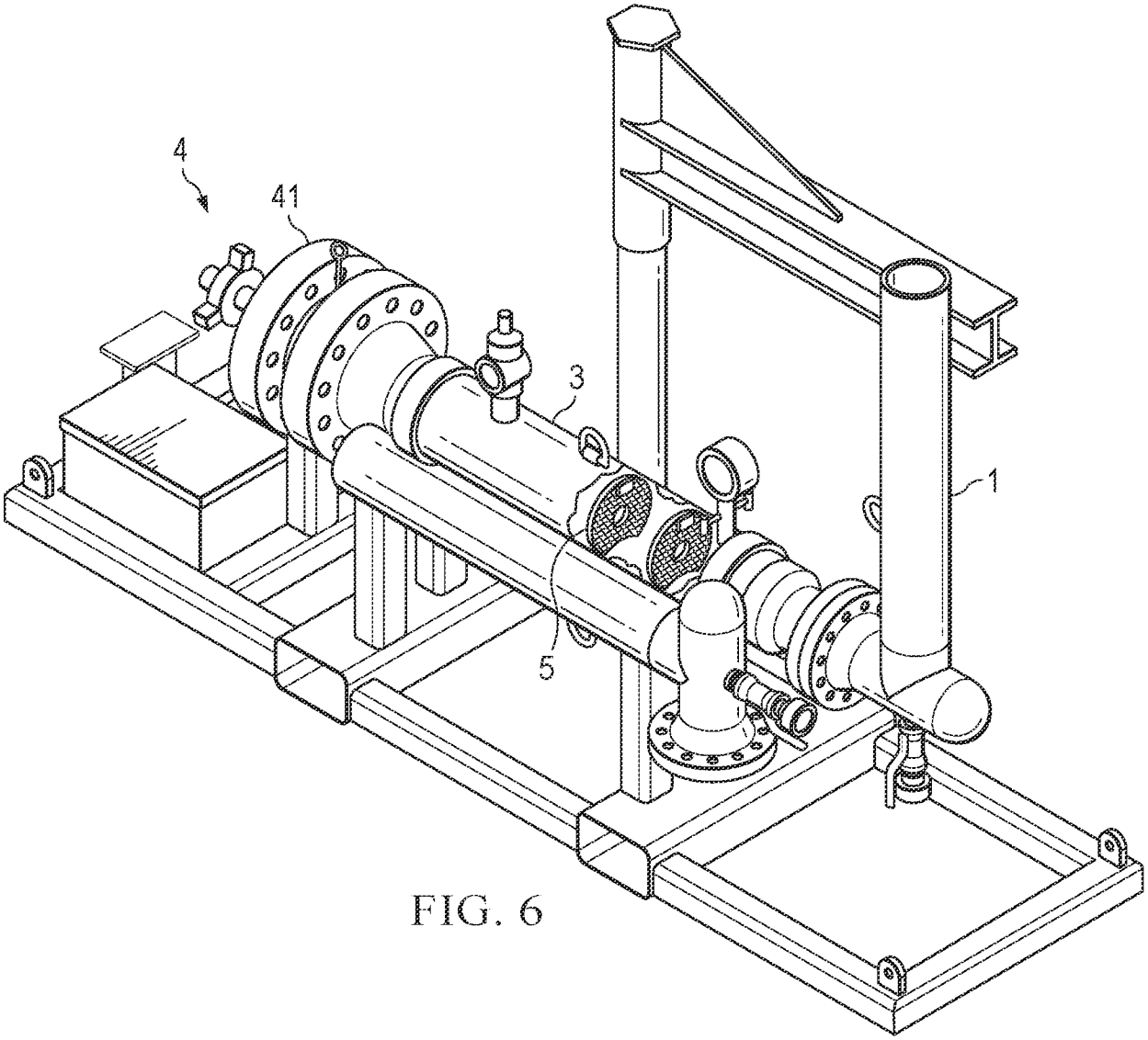
FIG. 6 is a perspective, partial cutaway view of a mud shearing system in accordance with various embodiments of the present disclosure.
Figure 7:
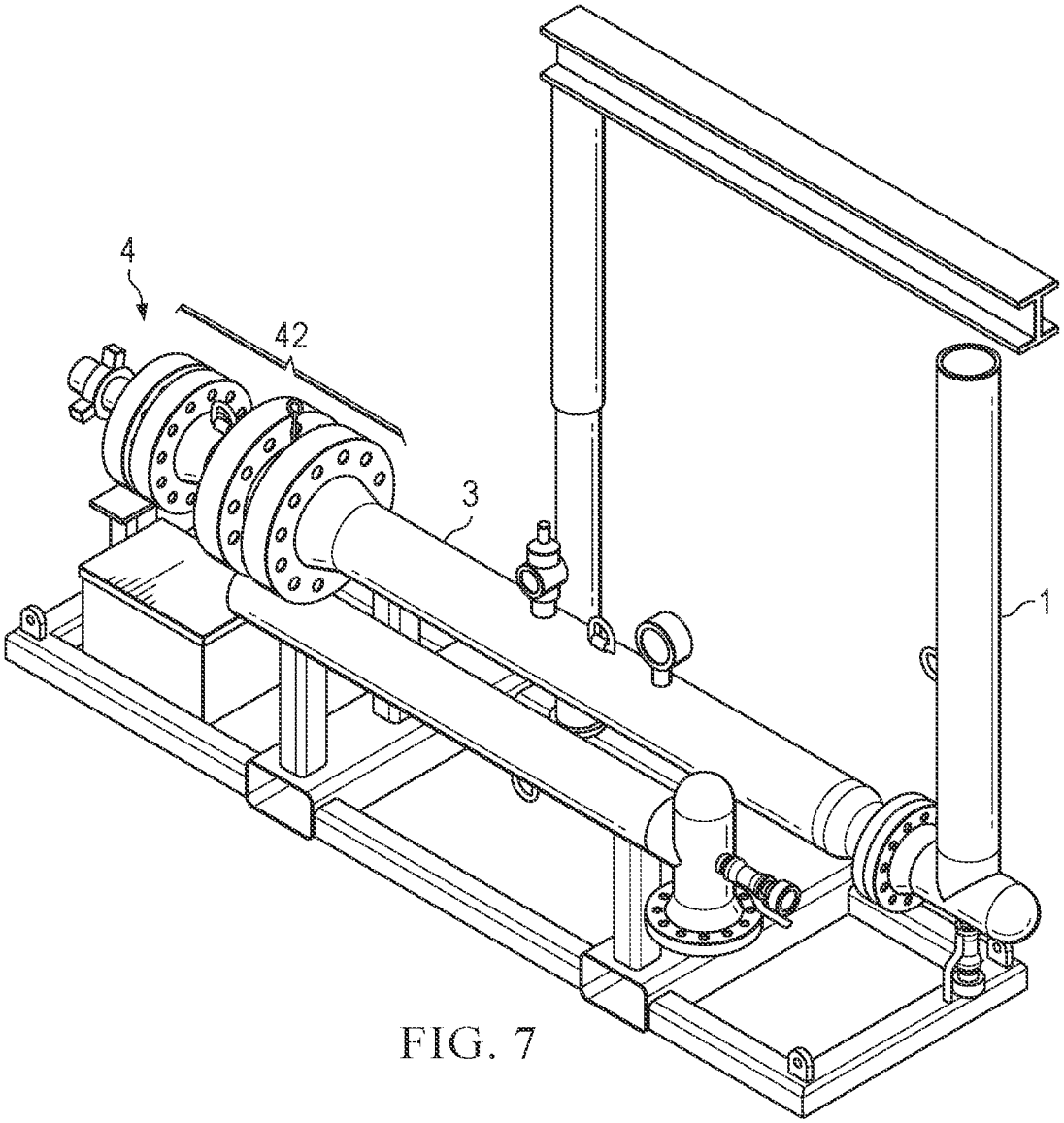
FIG. 7 is a perspective view of a mud shearing system in accordance various embodiments of the present disclosure including an additional outlet vessel mounted to the system as may be the case during shipping.
Figure 8:
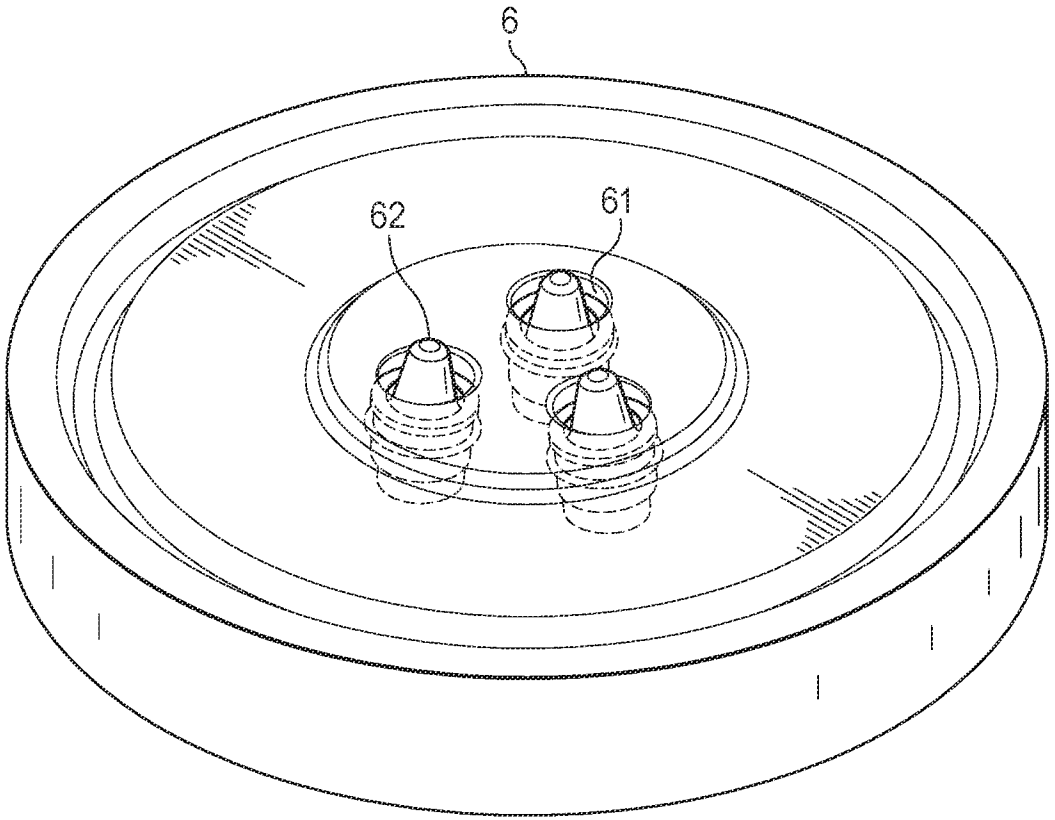
FIG. 8 is a perspective, sectional view of a shearing plate in accordance with various embodiments of the present disclosure.
Figure 9:
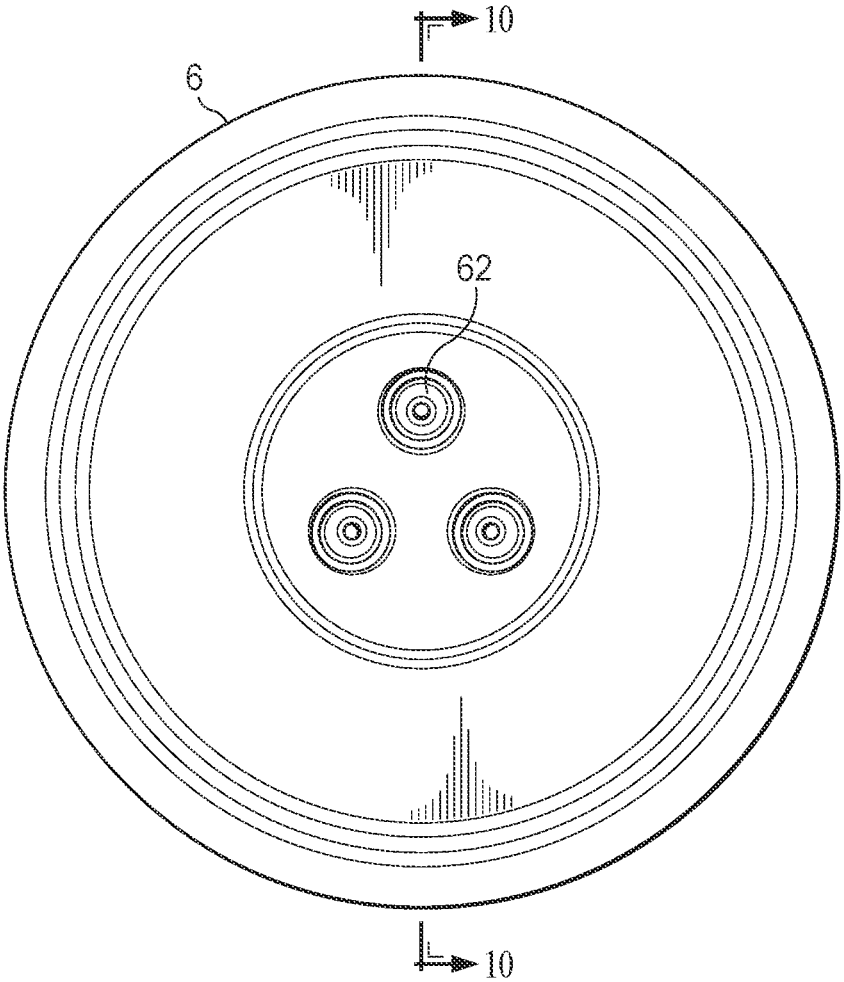
FIG. 9 is a back view of a shearing plate and nozzles in accordance with various embodiments of the present disclosure.
Figure 10:
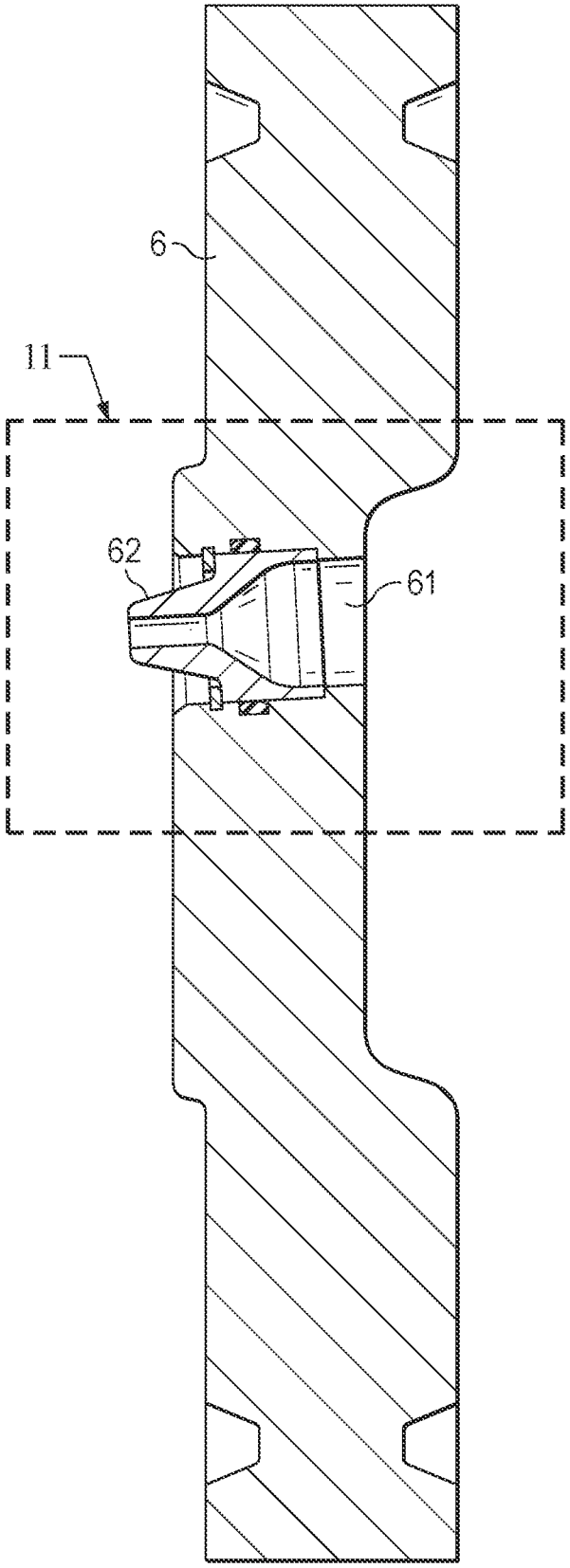
FIG. 10 is a cross-sectional, side view of the shearing plate of FIG. 9 rotating along axis 10.
Figure 11:
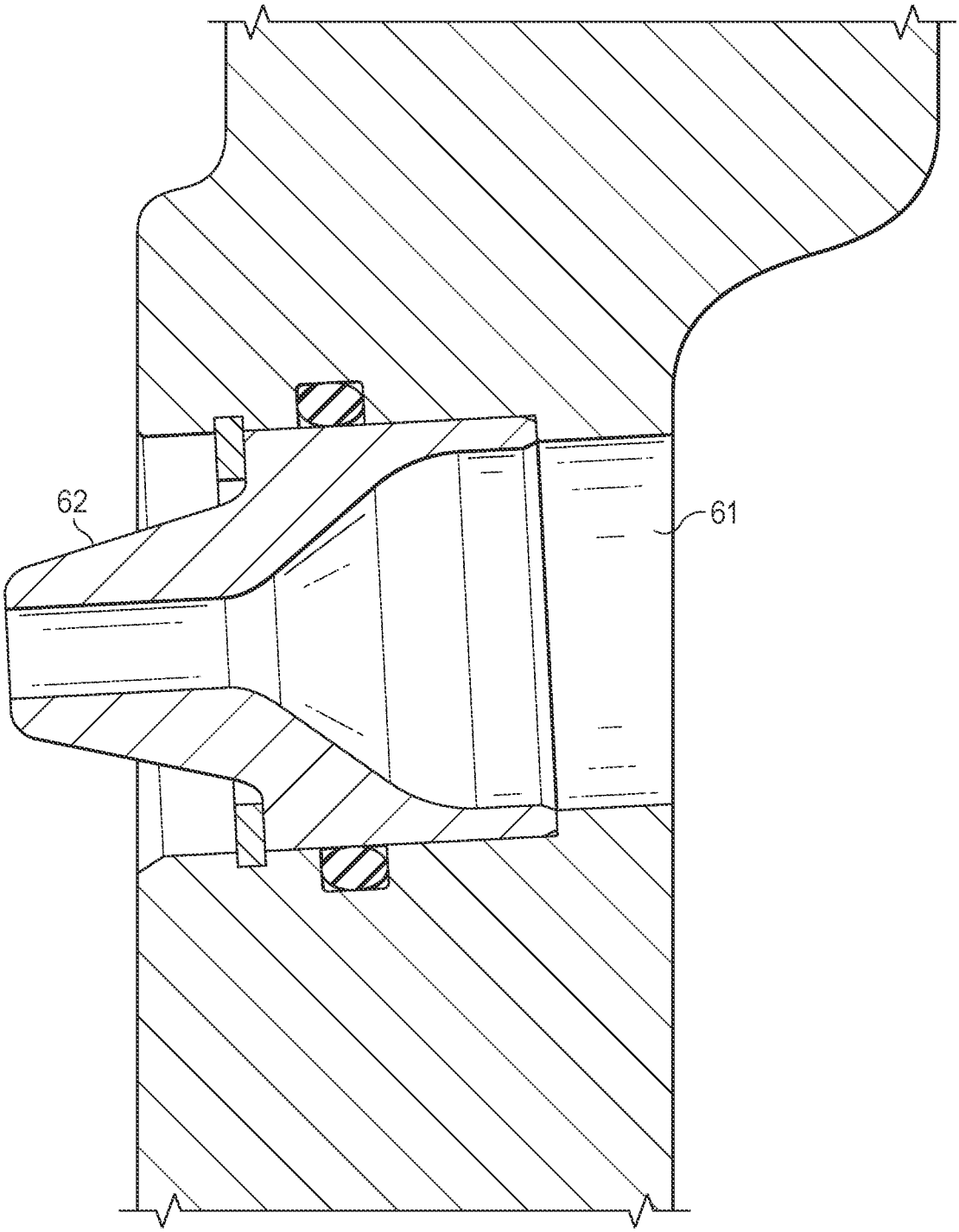
FIG. 11 is an exploded view of the shearing aperture and nozzle of FIG. 10.
Figure 12:
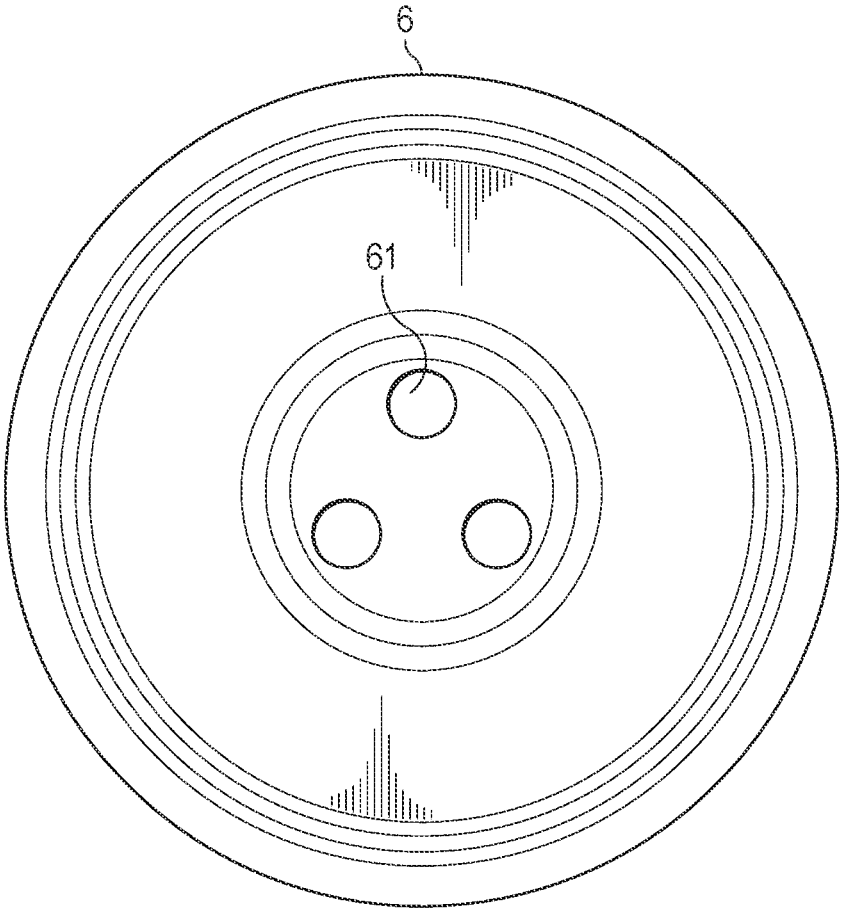
FIG. 12 is a front view of a shearing plate in accordance with various embodiments of the present disclosure.
Figure 13:
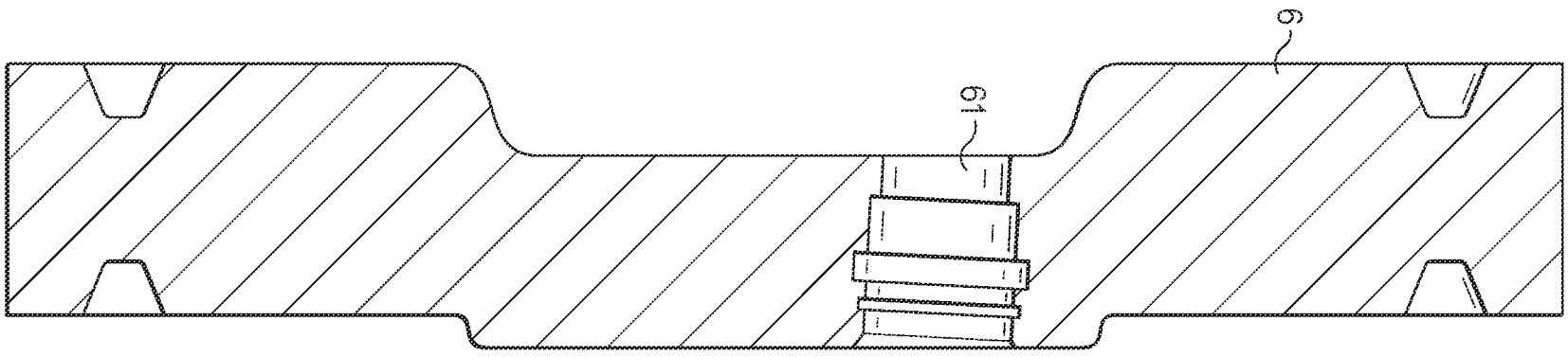
FIG. 13 is a cross-sectional, side view of a shearing plate in accordance with various embodiments of the present disclosure.
Figure 14:
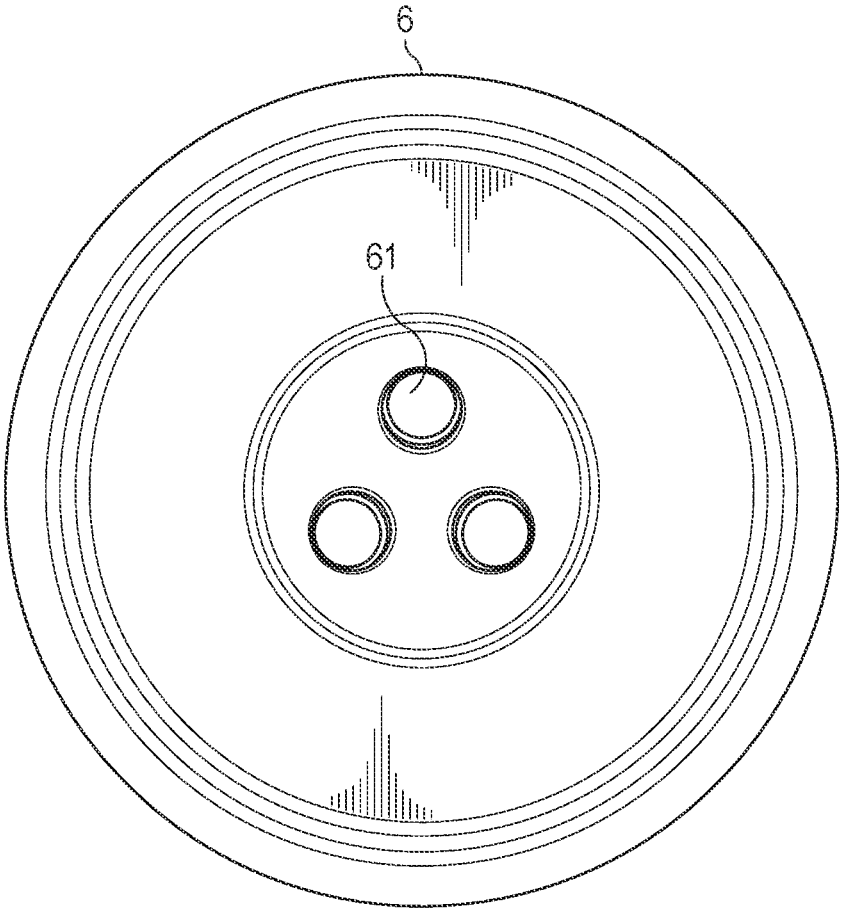
FIG. 14 is a front view of a shearing plate having shearing apertures in accordance with various embodiments of the present disclosure.
Figure 15:
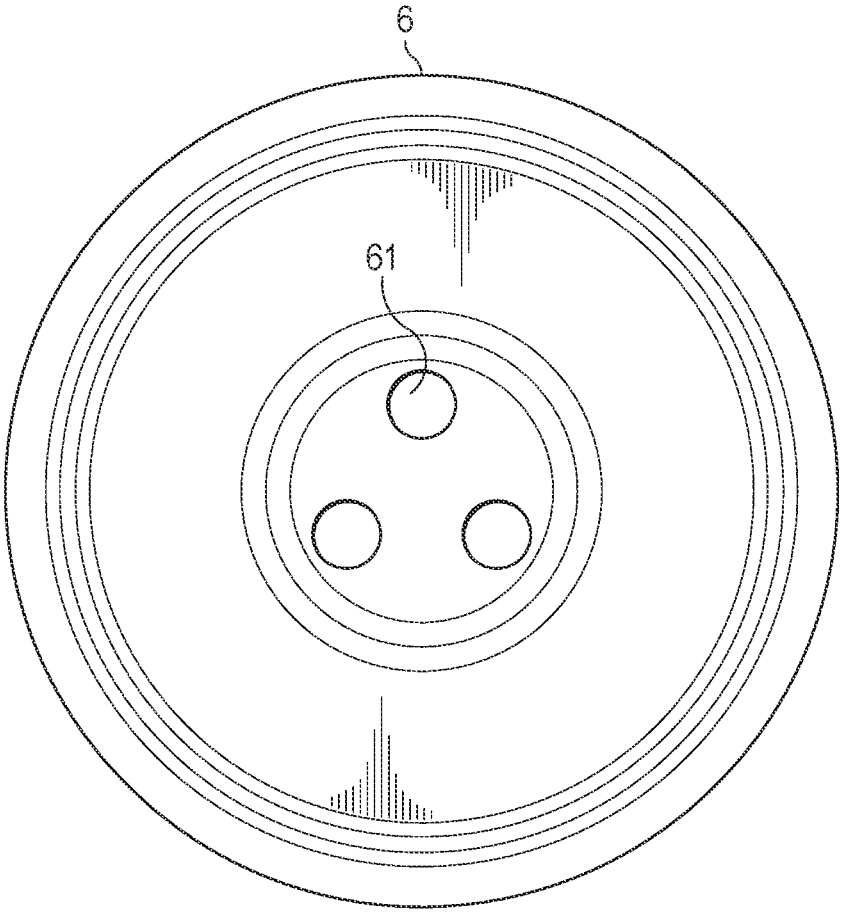
FIG. 15 is a back view of a shearing plate having shearing apertures in accordance with various embodiments of the present disclosure.

In further embodiments, such as those depicted in FIGS. 4-6, a mud shearing system may similarly comprise an inlet portion 4, a shearing plate 6, a main body 3, and an outlet vessel 1. In such embodiments, inlet portion 4 may be a specially configured inlet flange 41 which is arranged in fluid communication with main body 3. Shearing plate 6 may be disposed between inlet flange 41 and main body 3 and configured to modify the flow rate of a fluid, such as chilling mud, that is passing from inlet flange 41 to main body 3 through shearing plate 6. Shearing plate 6 may be configured to be received in a flanged connection between inlet flange 41 and main body 3.

Figure 18:
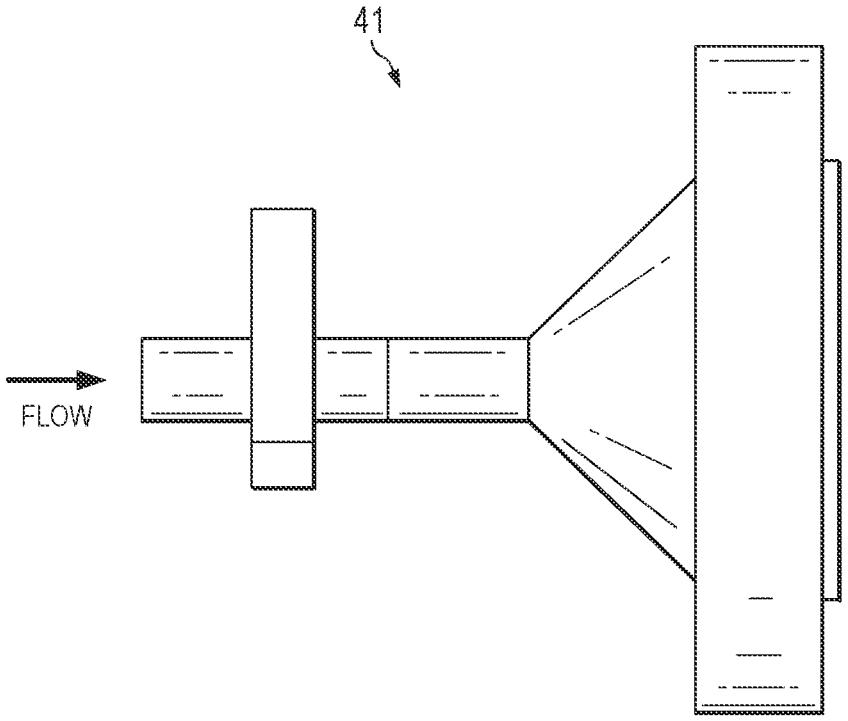
FIG. 18 is a side, schematic view of an inlet flange configuration in accordance with various embodiments of the present disclosure.
Figure 20:
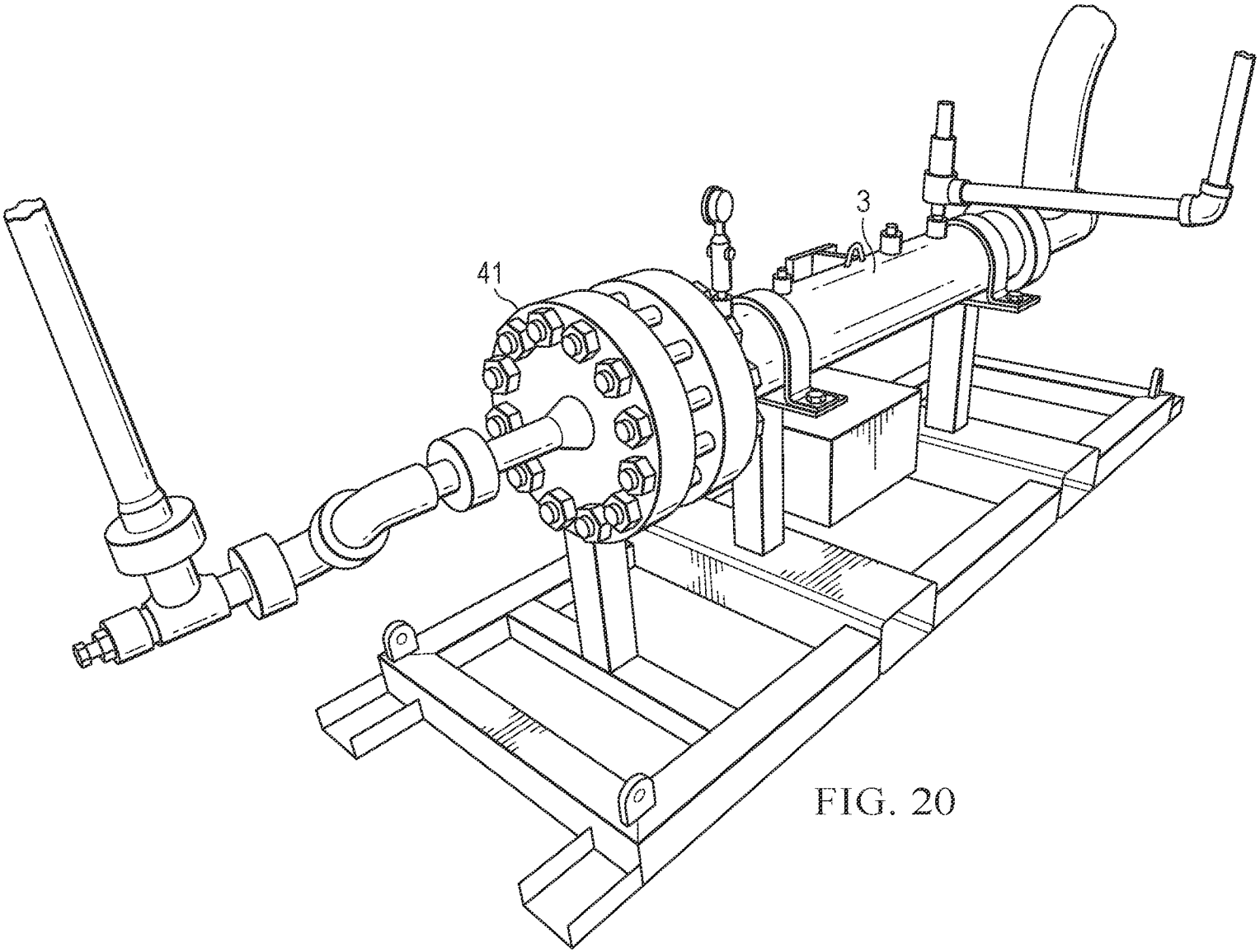
FIG. 20 is a perspective view of a mud shearing system in accordance with various embodiments of the present disclosure.
Figure 21:
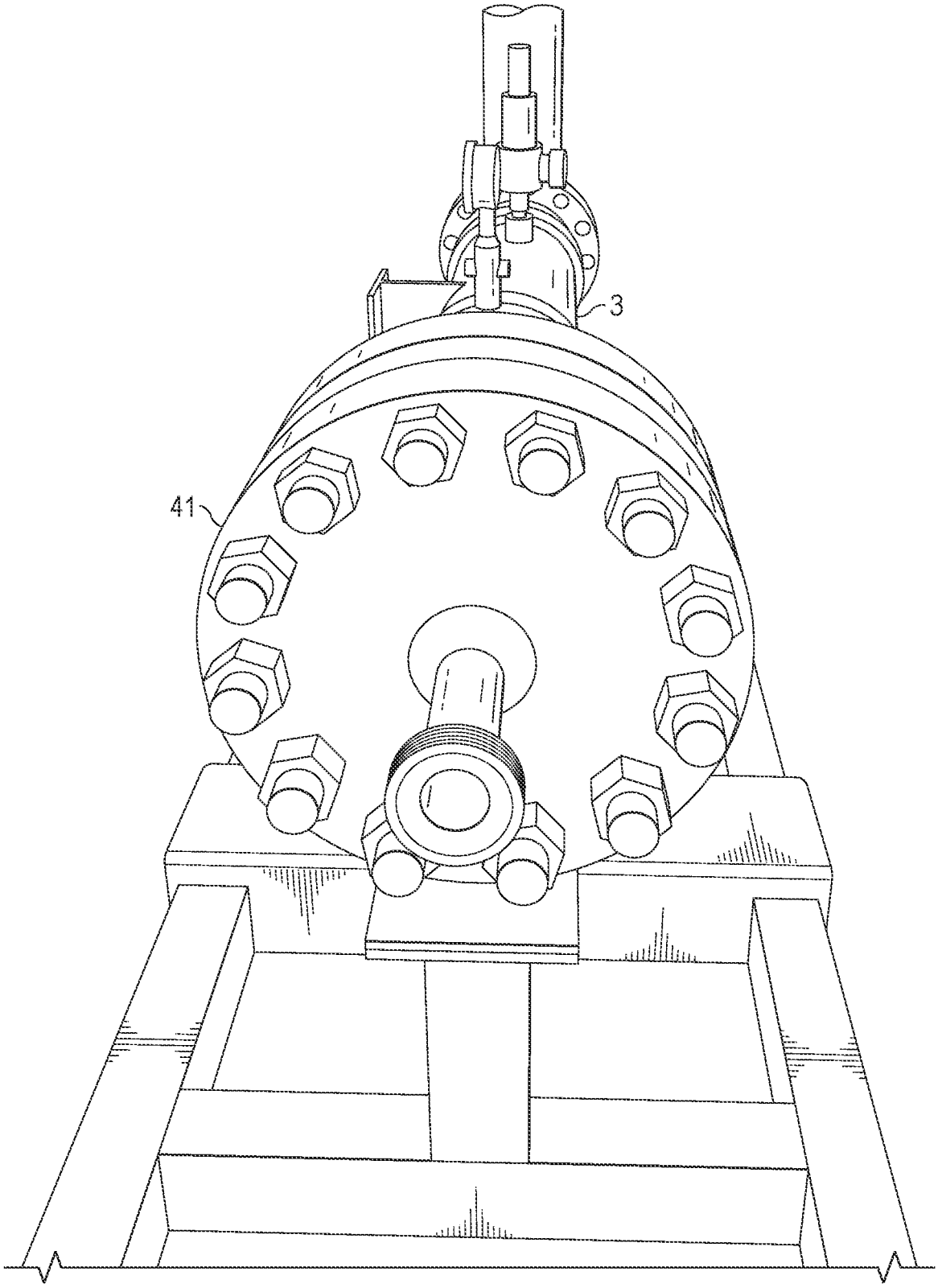
FIG. 21 is a front, perspective view of an inlet flange configuration in accordance with various embodiments of the present disclosure.
Figure 22:
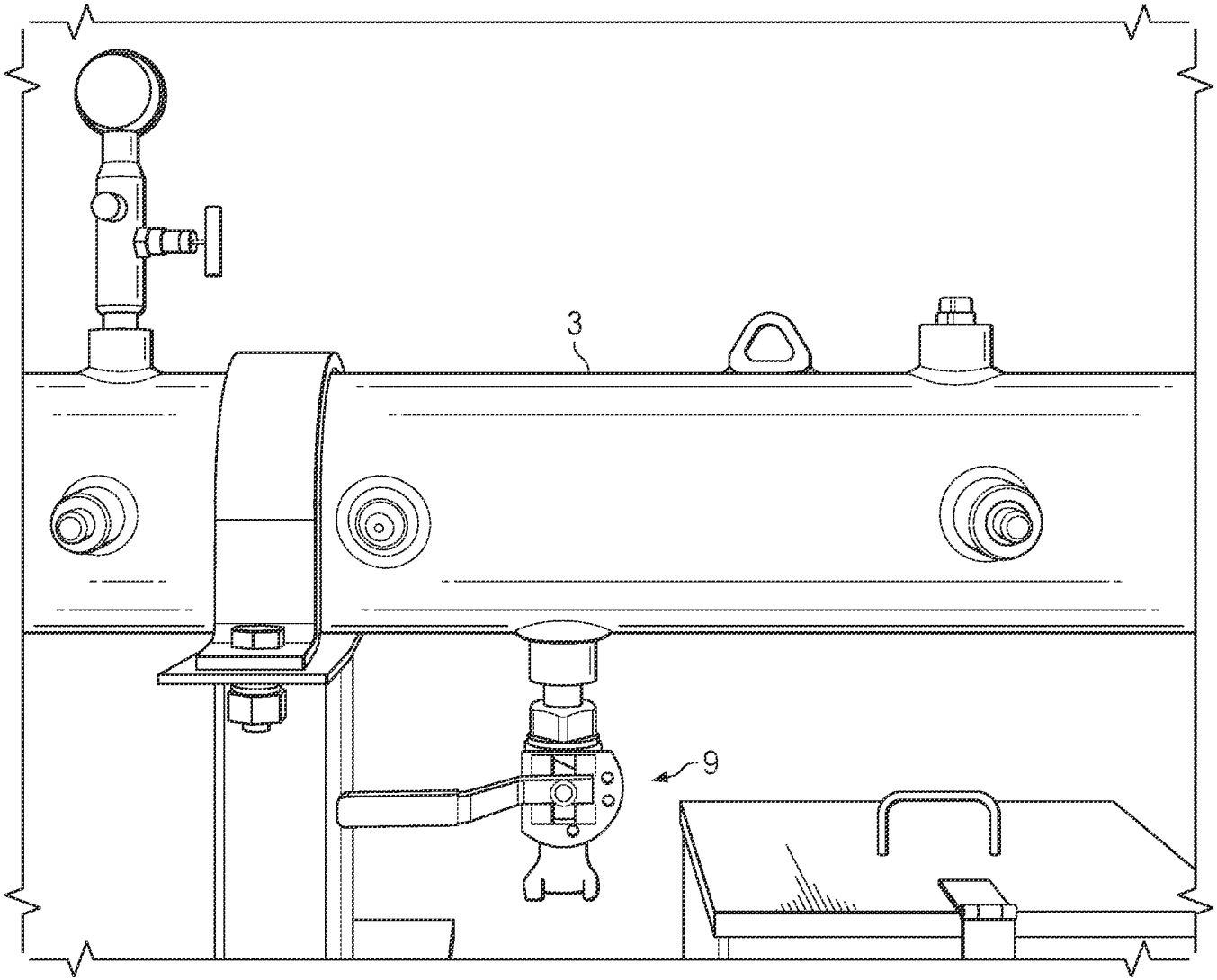
FIG. 22 is a partial side, perspective view of a main body and jet line of a mud shearing system in accordance with various embodiments of the present disclosure.

Inlet flange 41, such as that depicted in FIGS. 18, 20, and 21, may be specially configured and custom machined to permit fluid transmission from a pump, basket strainer, or other external fluid source to a mud shearing system without additional, intervening inlet flanges between inlet flange 41 and shearing plate 6. Inlet flange 41 may have a first end configured for coupling with a smaller diameter vessel, such as a 2-inch pipe, and a second end configured for coupling with a larger diameter vessel, such as an 8-inch pipe.

Looking to FIGS. 8-15, shearing plate 6, in accordance with embodiments of the present disclosure, may be configured to be received in a flanged connection between inlet portion 4 and main body 3. One or more shearing apertures 61 may be formed into shearing plate 6. Each of the one or more shearing apertures 61 may be configured to house and securely retain a respective fluid nozzle 62. A nozzle 62 is configured to allow fluid communicated through inlet portion 4 to pass from a back end of nozzle 62 exposed along a front surface of shearing plate 6 through to a front end, or tip, of nozzle 62 exposed along a back surface of shearing plate 6 thereby directing the flow of such fluid through to main body 3. Use of nozzles 62 allows manipulation of flow rate and pressure as fluid is passed through shear plate 6 and thereby facilitates the shearing process. The size, spacing, orientation, angle, and type of any nozzle 62 may vary depending on the application and intended use of a particular mud shearing system. For example, although three nozzles 62 are depicted in these figures, alternative embodiments may include between two and six such nozzles. Shearing plate 6 may also feature an eye bolt to facilitate assembly of the system.

Figure 19:
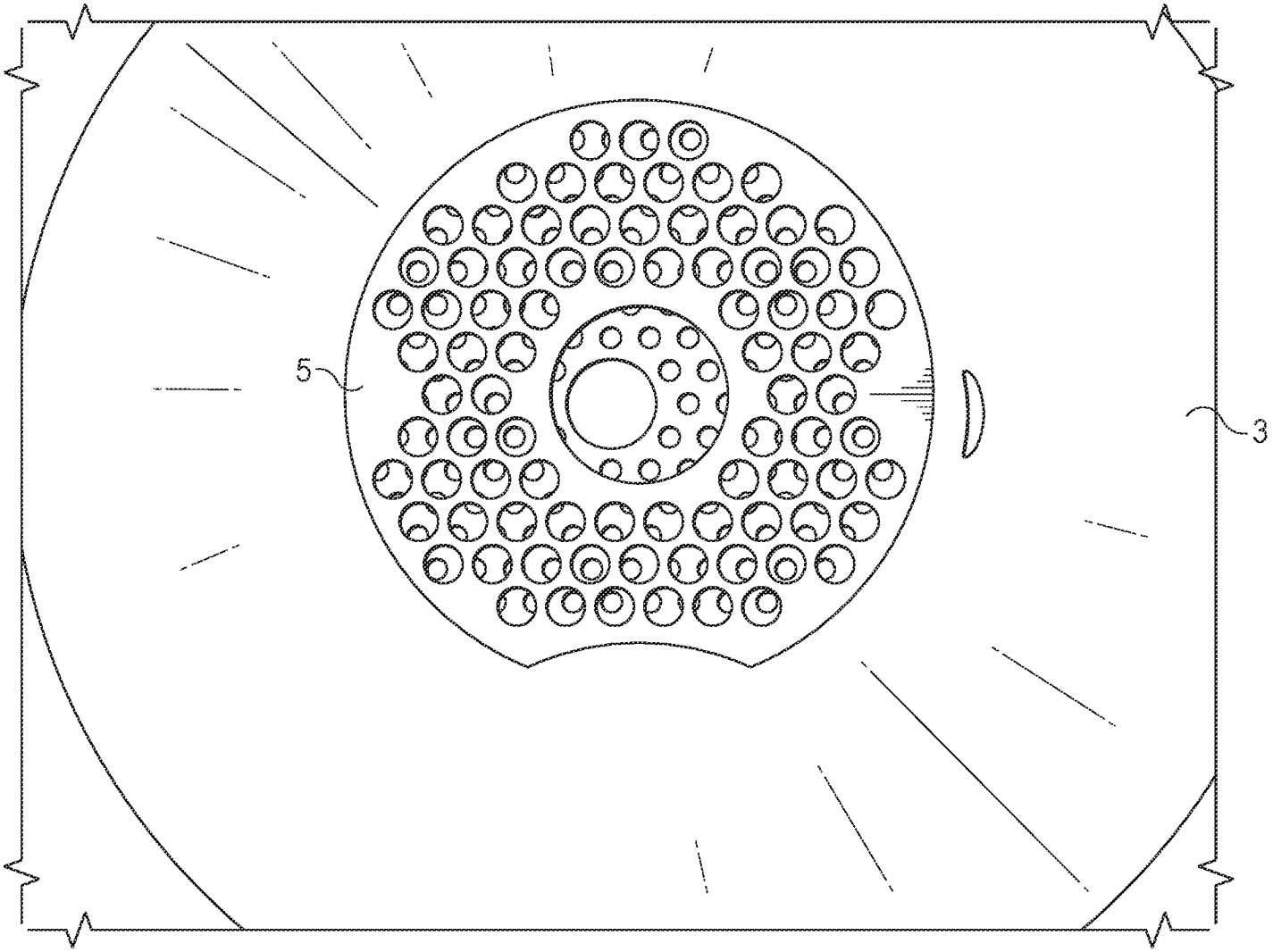
FIG. 19 is a front, perspective view of a baffle system disposed within a main body of a mud shearing system in accordance with various embodiments of the present invention.

Within various embodiments of the present disclosure, main body 3 is a substantially hollow tubular vessel such as a pipe defining an internal volume. A baffle system including one or more baffle plates 5 may be disposed within the internal volume along the longitudinal axis of main body 3 as depicted in FIGS. 4-6, and 17 to provide an additional shear factor in the system for the smaller particles after passing through shearing plate 6. Each baffle plate 5 may be positioned to disrupt the flow of fluid through main body 3 while still permitting fluid to flow around or through the baffle plate. As a result, with a single pass, shearing systems in accordance with such embodiments utilizing baffle plates 5 may generate a homogenous drilling mud with required rheological properties using optimum products concentrations. An exemplary baffle plate 5, as depicted in FIG. 19, may be a substantially flat surface having a plurality of apertures formed within that surface through which fluid may flow. Main body 3 may be coupled in fluid communication with outlet vessel 1 via a flanged connection 2. Further, main body 3 may be configured to accommodate a pressure safety valve 7 and a pressure gauge S. Both main body 3 and outlet vessel 1 may include one or more jet lines 9 that are configured to facilitate cleaning of the respective vessels.

Embodiments of shearing systems described herein may be optionally fed fluid via a high-pressure triplex pump that causes such fluid to circulate through the high-pressure hydraulic shear device at different flow rates and pressures to generate a stable emulsion and rheology in the fluid. As drilling mud, or other fluid, enters the main body 3 through the inlet portion 4 it is then pumped through the nozzles 62, housed within shearing apertures 61. The drilling mud is then passed through a baffle system (comprising baffle plates 5) to allow for further disruption of particles. Through these systems, the hydraulic power of the pump is capable of exceeding critical energy density and imparting the hydraulic shear required to create the desired rheology of the drilling mud. In certain embodiments, more than one pump may be utilized to increase the hydraulic power within the system. Once an emulsified liquid is formed, the fluid can leave the main body 3 through outlet vessel 1. Such systems may also include a skid assembly or unit for operation or transportation of the systems. A jib crane may be used to facilitate system assembly, system disassembly, or repair/replacement of system components.

Shearing systems in accordance with embodiments of the present disclosure allow for drilling mud to be processed and obtain desired rheological properties in a single pass, without the need for multiple treatment cycles.

What is claimed is:

1. A system for emulsifying drilling mud comprising:

an inlet assembly comprising:

a first inlet flange configured to receive a volume of mud; and a second inlet flange operationally coupled to the first inlet flange, wherein a maximum diameter of the first inlet flange is less than a maximum diameter of the second inlet flange;

a shearing plate coupled to the second inlet flange and including three nozzles in a substantially triangular arrangement positioned around a center point of said shearing plate;

a substantially tubular vessel in fluid communication with the shearing plate via the three nozzles disposed in the shearing plate, wherein one or more baffle plates are arranged along a length of the tubular vessel within an interior volume of the tubular vessel; and an outlet pipe.

2. The system of claim 1, wherein the one or more baffle plates comprises two baffle plates.

3. The system of claim 2, wherein the volume of mud has been strained by a basket strainer prior to contact with the inlet assembly.

4. The system of claim 3, further comprising a transport skid upon which the inlet assembly, the shearing plate, and the tubular vessel are disposed.

5. A system for emulsifying drilling mud comprising:

an inlet flange configured to receive a volume of mud from a feeding vessel;

a shearing plate coupled to the inlet flange and including three nozzles in a substantially triangular arrangement positioned around a center point of the shearing plate;

a substantially tubular vessel in fluid communication with the shearing plate via at least one nozzle disposed in the shearing plate, wherein one or more baffle plates are arranged along a length of the tubular vessel within an interior volume of the tubular vessel, wherein a diameter of the inlet flange decreases from tubular vessel towards the feeding vessel; and an outlet pipe.

6. The system of claim 5, wherein the one or more baffle plates comprises two baffle plates.

7. The system of claim 6, wherein the volume of mud has been strained by a basket strainer prior to contact with the inlet flange.

8. The system of claim 7, further comprising a transport skid upon which the inlet flange, the shearing plate, and the tubular vessel are disposed.

* * * * *